US006526796B1

(12) United States Patent
Markarian

(10) Patent No.: US 6,526,796 B1
(45) Date of Patent: Mar. 4, 2003

(54) AUTOMOBILE BODY FRAME PULLER ATTACHMENT

(76) Inventor: Hofseb K. Markarian, 4988 Parker Street, Burnaby BC (CA), V5B 1Z6

( * ) Notice: Subject to any disclaimer, the term of this patent is extended or adjusted under 35 U.S.C. 154(b) by 48 days.

(21) Appl. No.: 09/939,045

(22) Filed: Aug. 24, 2001

(51) Int. Cl.[7] ..... B21D 1/00; B21D 25/00

(52) U.S. Cl. ..... 72/293; 72/308; 72/457; 72/705

(58) Field of Search ..... 72/293, 308, 457, 72/705; 254/133 R

(56) References Cited

U.S. PATENT DOCUMENTS

| | | | | |
|---|---|---|---|---|
| 3,338,086 A | | 8/1967 | Hunter | |
| 3,610,022 A | | 10/1971 | Lincourt | |
| 3,797,295 A | | 3/1974 | Sanchez | |
| 3,879,814 A | | 4/1975 | Mojelski | |
| 4,248,078 A | | 2/1981 | Russo | |
| 4,770,025 A | | 9/1988 | Graf | |
| 4,825,679 A | * | 5/1989 | Cortinovis | 72/308 |
| D311,316 S | | 10/1990 | Ishihara | |
| 5,247,824 A | | 9/1993 | Horan | |
| 5,335,533 A | | 8/1994 | Rehus | |
| 5,535,973 A | | 7/1996 | Bailey et al. | |
| 6,122,953 A | | 9/2000 | Markarian | |
| 6,453,715 B1 | * | 9/2002 | Venalainen | 72/308 |

* cited by examiner

*Primary Examiner*—Ed Tolan

(57) ABSTRACT

A vehicle body frame puller attachment which includes a generally triangular main member having three sides with opposite side edges extending along each of the sides. The main member comprises a first side adapted for coupling to a chain to facilitate pulling on the main member using the chain, with a generally round aperture for freely passing a portion of a chain therethrough and a pair of chain slots for positioning a link of the chain in one of the chain slots such that an adjacent link in the chain is prevented from passing through the chain slot. A second side has four door hinge slots with each of the door hinge slots being elongate and having longitudinal axes extending substantially parallel to the side edges. A third side has a plurality of bolt slots for coupling to various bolt patterns used to attach door hinges to different vehicles. Optionally, a pair of brackets is provided for adjustably coupling to the door hinge slots of the second side of the main member and for engaging a respective end of a door hinge on a door post of the vehicle body. Also optionally, a loop may be mounted on the main member for receiving a portion of a chain, with the loop being looped about the main member.

20 Claims, 4 Drawing Sheets

AUTOMOBILE BODY FRAME PULLER ATTACHMENT

BACKGROUND OF THE INVENTION

1. Field of the Invention

The present invention relates to vehicle body attachments and more particularly pertains to a new vehicle body frame puller attachment for providing a versatile attachment device having a multiplicity of connection structures for attaching to various points on a vehicle body.

2. Description of the Related Art

The use of vehicle body attachments for permitting large pulling forces to be applied to various portions of the body of a vehicle at various locations, typically for pulling a damaged portion of the vehicle body, such as a frame rail, substantially back into its position prior to the occurrence of the damage. Specialized attachments have been developed for different locations or body structures, and some of the attachments are able to attach to more than one location on a vehicle body or more than one vehicle body style or brand.

One vehicle body attachment is described in my U.S. Pat. No. 6,122,953 (the disclosure of which is hereby incorporated by reference in its entirety) is extremely versatile for attaching to a multiplicity of various structures on a vehicle body, especially structures typically located adjacent to the door openings on the vehicle body such as door hinges and door hinge mounts. While this vehicle body attachment is very useful in many different vehicle body mounting applications, it has become apparent that further improvements of the attachment would make the attachment even more versatile for adapting to different vehicle body structures, such as frame rails, and would improve the ability to connect to a pulling chain.

The vehicle body frame puller attachment according to the present invention substantially departs from the conventional concepts and designs of the prior art, and in so doing provides an apparatus primarily developed for the purpose of providing a versatile attachment device having a multiplicity of connection structures for attaching to various points on an vehicle body.

SUMMARY OF THE INVENTION

In view of the foregoing disadvantages inherent in the known types of vehicle body attachments now present in the prior art, the present invention provides a new vehicle body frame puller attachment wherein the same can be utilized for providing a versatile attachment device having a multiplicity of connection structures for attaching to various points on an vehicle body.

The present invention generally comprises a generally triangular main member having three sides with opposite side edges extending along each of the sides. The main member comprises a first side adapted for coupling to a chain to facilitate pulling on the main member using the chain, with a generally round aperture for freely passing a portion of a chain therethrough and a pair of chain slots for positioning a link of the chain in one of the chain slots such that an adjacent link in the chain is prevented from passing through the chain slot. A second side has four door hinge (and frame rail) slots with each of the door hinge slots being elongate and having longitudinal axes extending substantially parallel to the side edges. A third side has a plurality of bolt slots for coupling to various bolt patterns used to attach door hinges to different vehicles. Optionally, a pair of brackets is provided for adjustably coupling to the door hinge slots of the second side of the main member and for engaging a respective end of a door hinge on a door post of the vehicle body. Also optionally, a loop may be mounted on the main member for receiving a portion of a chain, with the loop being looped about the main member.

The invention has special versatility for pulling on various locations of the frame rails of a vehicle body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
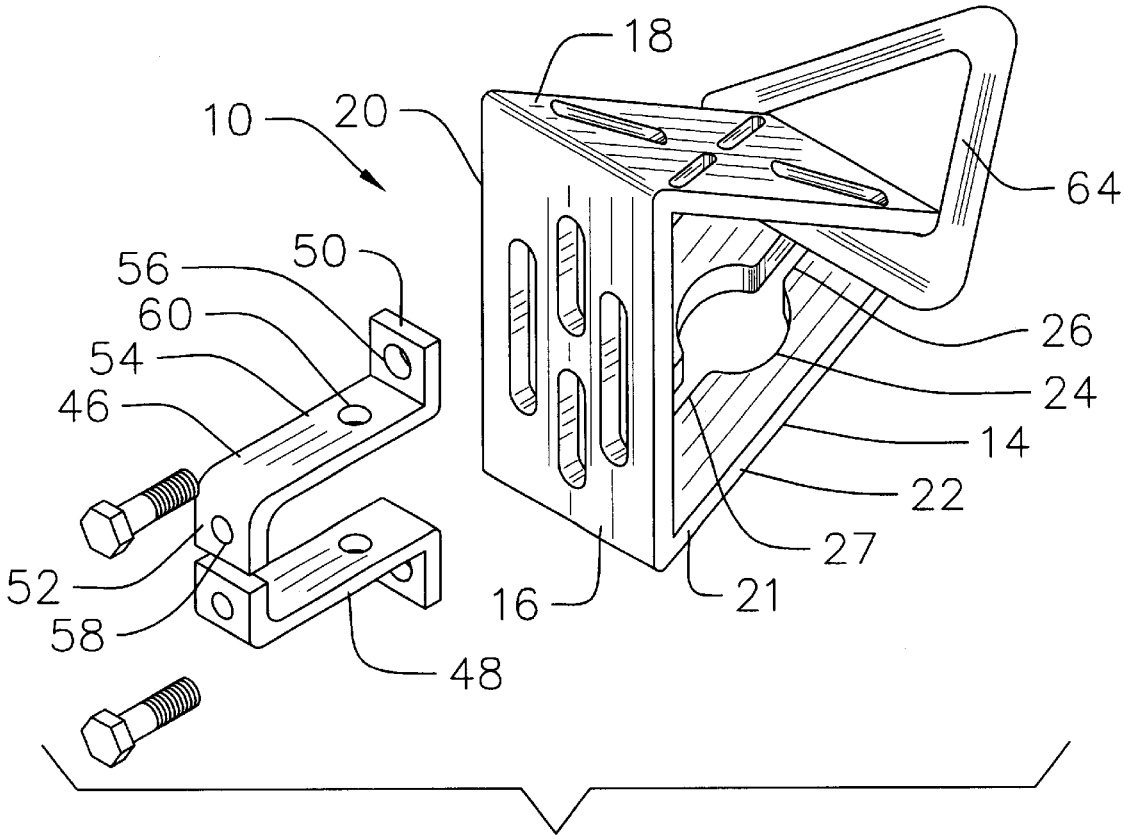
FIG. 1 is a schematic perspective view of a new universal side impact auto puller attachment according to the present invention.
Figure 2:
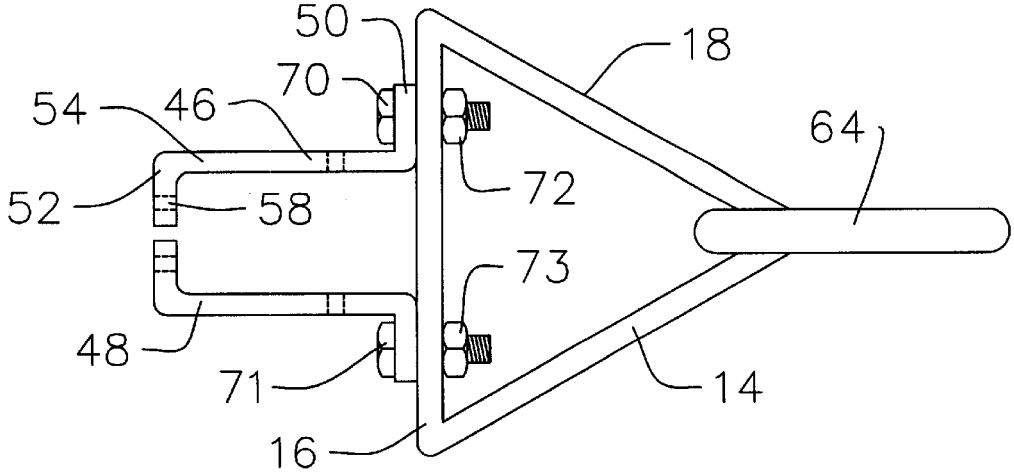
FIG. 2 is a schematic side view of the present invention.
Figure 3:
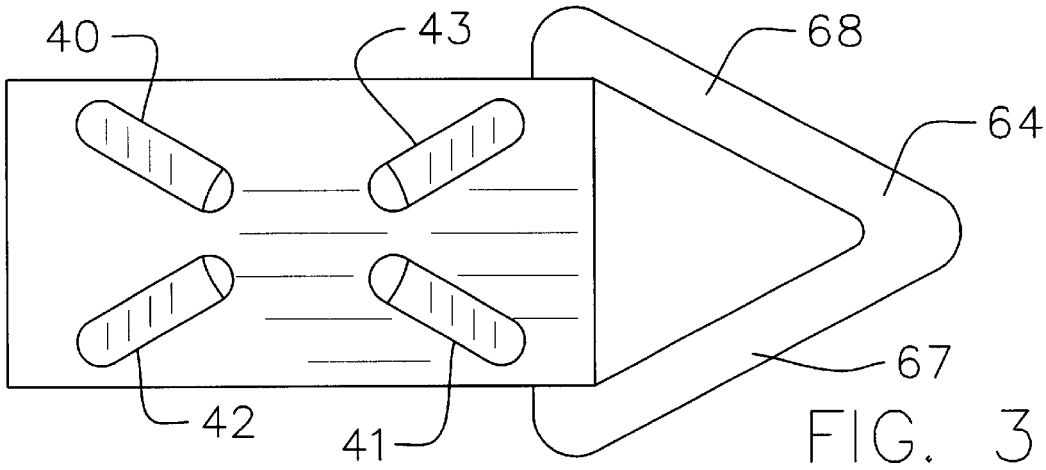
FIG. 3 is a schematic rear view of the present invention.
Figure 4:
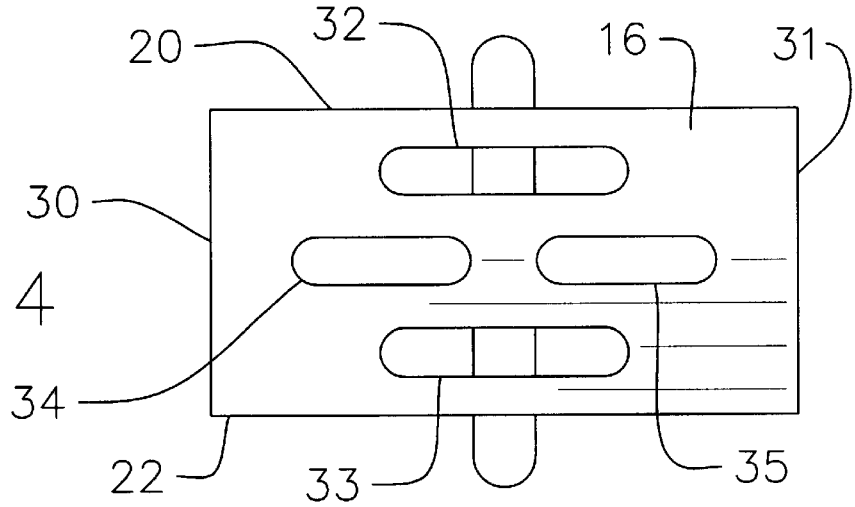
FIG. 4 is a schematic front view of the present invention.
Figure 5:
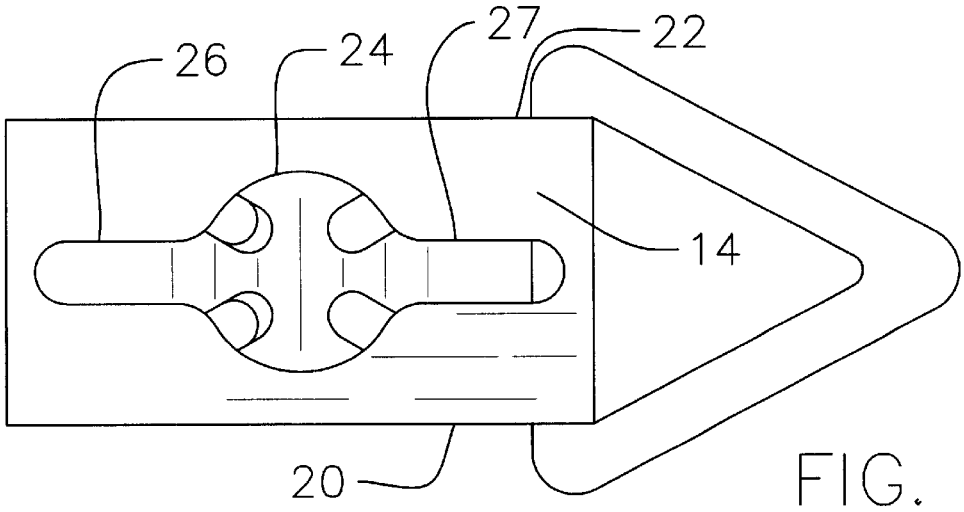
FIG. 5 is a schematic bottom view of the present invention.

With reference now to the drawings, and in particular to FIGS. 1 through 6 thereof, a new vehicle body frame puller attachment embodying the principles and concepts of the present invention and generally designated by the reference numeral 10 will be described.

As best illustrated in FIGS. 1 through 6, the vehicle body frame puller attachment of the invention generally comprises an attachment system 10 for attaching to a portion of a vehicle body for pulling on the portion of the vehicle body. The system includes a main member 12 and may include a loop 64 and one or more brackets 46, 48.

The attachment system 10 of the invention features the main member, which may be generally triangular with three sides 14, 16, and 18. Each of the sides may be substantially planar with an interior face and an exterior face. The main member 12 has opposite side edges 20, 22. The main member 12 includes a first side 14, a second side 16, and a third side 18.

Figure 6:
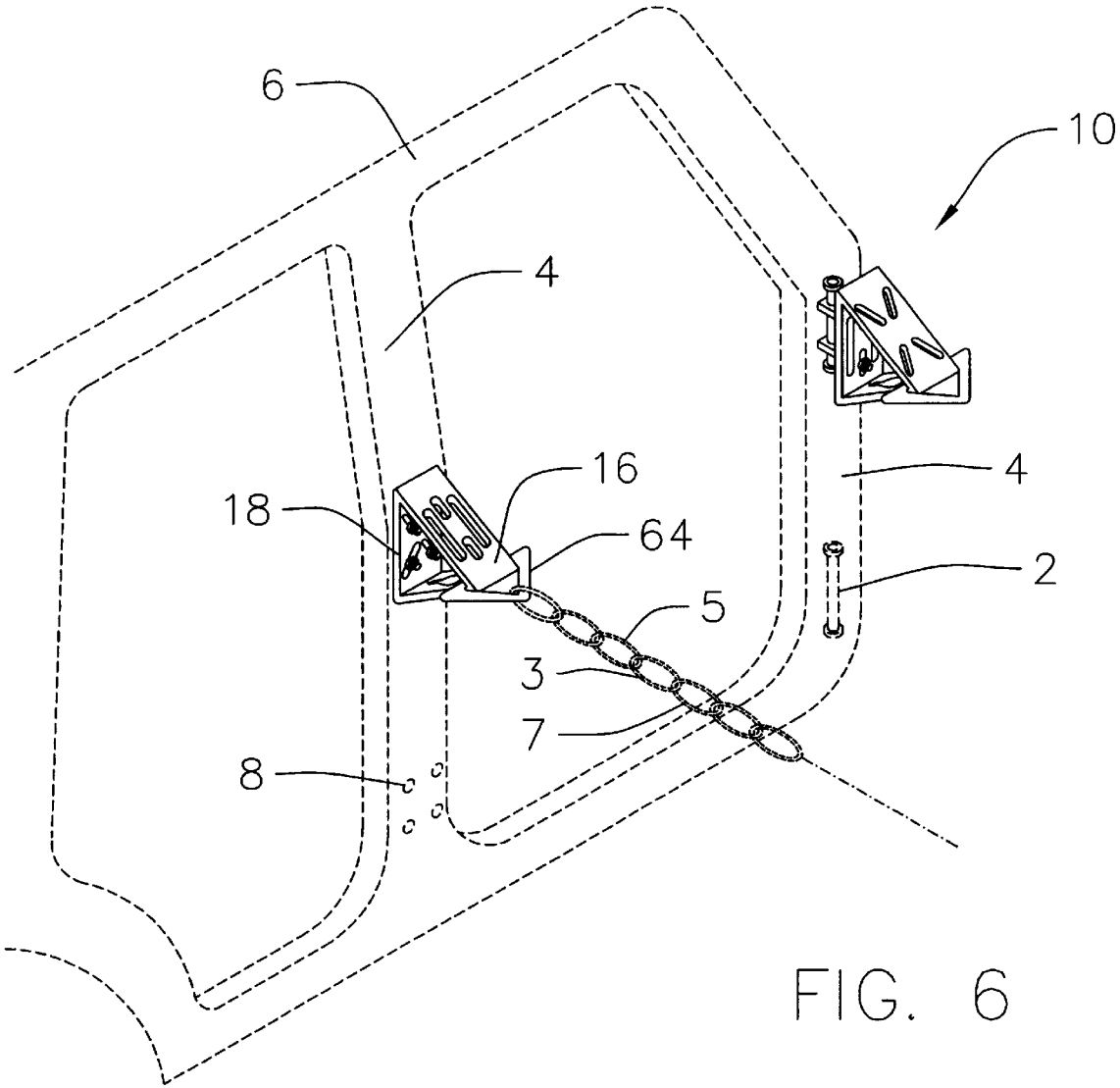
FIG. 6 is a schematic perspective view of the present invention in use.

The first side 14 is preferably adapted for coupling to a chain 5 to facilitate pulling on the main member using the chain. The first side has a generally round aperture 24 for freely passing a portion of a chain therethrough, and is preferably sized to accomplish this function. The aperture extends through the first side between the interior and exterior faces of the side. The first side may further have a pair of chain slots 26, 27 formed therein and in communication with the aperture 24, with each of the chain slots being adapted for receiving a link of the chain such that an adjacent link in the chain is prevented from passing through the chain slot. The chain slots 26, 27 may extend outwardly from the aperture 24. The pair of slots may extend in diametrically opposite directions so that the chain may be effectively attached to the main member when either one of the second or third sides is attached to a vehicle body. The pair of slots are elongate and have longitudinal axes extending substantially parallel to the side edges 20, 22. The first side is thus adapted for passing a chain 5 through the aperture, and the chain slot is adapted for positioning a link 3 of the chain in the chain slot such that an adjacent link 7 in the chain is prevented from passing through the chain slot. Thus, the first side is designed for coupling to the chain to facilitate pulling of the main member using the chain. As seen in FIG. 6, the chain slot is particularly useful for pulling the main member forward or backward or laterally with respect to the orientation of the vehicle.

The second side 16 of the main member may be elongate with opposite ends 30, 31. Four door hinge slots 32, 33, 34, 35 may extend through the second side between the interior and exterior faces. Each of the door hinge slots is elongate, and each preferably has a longitudinal axis that extends substantially parallel to the side edges. A first pair 32, 33 of the door hinge slots are transversely separated on the second side 16. Each of the first pair of door hinge slots has a central transverse axis that bisects the longitudinal axis of the slot, and the transverse central axis of each of the first pair of slots may be positioned approximately midway between the opposite ends of the second side. A second pair 34, 35 of the door hinge slots each have a common longitudinal axis that extends through each of the door hinge slots. The common longitudinal axis of the second pair of slots may be centrally located between the side edges of the second side. The second pair of door hinge slots may be longitudinally separated along the length of the second side between the ends 30, 31. The central transverse axis of the first pair 32, 33 of door hinge slots may pass approximately midway between the second pair 34, 35 of door hinge slots.

The third side 18 has a plurality of bolt slots for coupling to various bolt patterns used to attach door hinges to different vehicles. The bolt slots extend through the third side between the interior and exterior faces. The plurality of bolt slots may include a first pair 40, 41 of bolt slots and a second pair 42, 43 of bolt slots. Each pair of bolt slots may have a common longitudinal axis passing through each of the bolt slots of the respective pair. The common longitudinal axis of the first pair 40, 41 of bolt slots may intersect the common longitudinal axis of the second pair 42, 43 of bolt slots at a substantially central location on the third side 16. An angle between the common axes of the first and second pairs of bolt slots may measure approximately 60 degrees.

The invention may also include at least one bracket, and may include a pair of brackets 46, 48 for adjustably coupling to the door hinge slots 32, 33, 34, 35 of the second side of the main member and for engaging a respective end of a door hinge on a door post of the vehicle body. Each of the brackets 46, 48 may be adjustably slidable along one of the door hinge slots to accommodate coupling to door hinges having a range of hinge lengths. Each of the brackets is designed for engaging a respective end of a door hinge 2 on a door post 4 of a vehicle 6. Thus, the system 10 is couplable to the vehicle door post to facilitate pulling the door post back into proper alignment after an accident.

Each of the brackets 46, 48 may have a first end portion 50, a second end portion 52, and an intermediate portion 54 linking the first and second end portions. The first and second end portions may lie in substantially parallel planes, and the intermediate portion may lie in a plane oriented substantially perpendicular to the planes of the first and second end portions. The first and second end portions preferably extend in substantially opposite directions. The first end portion 50 may have a bolt hole 56 extending therethrough for receiving a fastener for securing the first end portion to the second side of the main member. The second end portion 52 may have a hole 58 for receiving a fastener for attaching the second end portion to a door hinge. The intermediate portion 54 may have a hinge post hole 60 for removably receiving a hinge post of the vehicle body. The hinge post holes are preferably axially alignable such that the hinge post holes are adapted for engaging respective ends of the hinge post of the vehicle.

Significantly, the invention includes a loop 64 that is mounted on the main member for receiving a portion of a chain to provide an optional manner of attaching a chain to the main member in addition to the aperture and slots of the first side. The loop 64 is looped about the main member such that the loop passes through the main member. The loop preferably has a triangular shape with three side extents 66, 67, 68 such that one of the side extents is positionable at a vertex of the main member with the loop extending away from the vertex of the main member.

A pair of bracket bolts 70, 71 and a pair of bracket nuts 72, 73 may be provided for attaching the brackets to the main member. The bracket bolts may be removably insertable through the bolt holes 56 and the slots in the main member for engaging the bracket nuts for coupling the first end portion to the second side.

The sides 14, 16, 18 of the main member 12 are preferably formed of a strong material (such as a metal) and are integrally joined together to form a triangular perimeter wall having open sides for receiving a chain through the open sides, and also the loop 64 is used.

Figure 7:
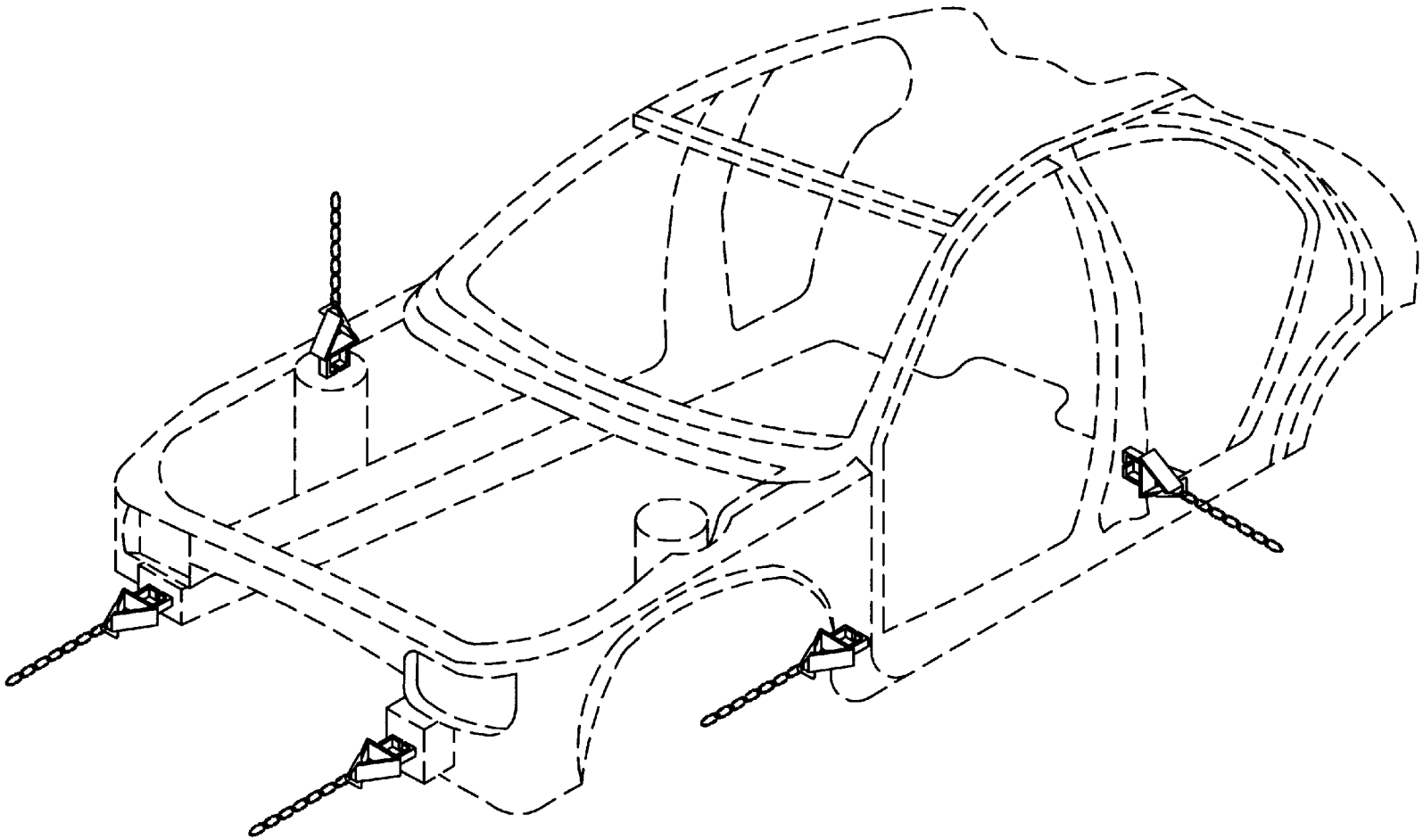
FIG. 7 is a schematic perspective view of a vehicle body with the puller attachment of the invention shown mounted at various locations to various body structures of the vehicle body.

In use, the attachment is easily adapted for connection to various locations on the body and frame of a vehicle (see FIG. 7). For example, the attachment may be mounted on the frame rail of the vehicle at various locations, such as on a forward location on the frame rail, and the frame rail may then be pulled in a longitudinal direction away from the vehicle body. As another example the attachment may be mounted on an upper location on the shock or strut support tower for pulling upwardly or laterally outward on the shock or strut support tower. The brackets are especially well suited for mounting to relatively flat and narrow flat surfaces on the body and frame rails.

Further, the attachment of the invention may be mounted on the vehicle body or chassis in positions adjacent to the door opening of the vehicle. The attachment may be mounted on door hinge mounting structures of the body below the A-pillar of the body, including an upper hinge mounting position and a lower hinge mounting position, and the body may be pulled in a laterally outward direction and in a longitudinally forward direction, depending upon the type of damage being repaired. It should be realized that the versatility of the connection structures on the attachment of the invention permits mounting of the attachment on virtually any location of the vehicle body structure having fastener receiving holes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachment system for attaching to a portion of a vehicle body for pulling on the portion of the vehicle body, the system comprising:

a generally triangular main member having three sides, the main member having opposite side edges extending along each of the sides, the main member comprising:

a first one of the sides being adapted for coupling to a chain to facilitate pulling on the main member using the chain, the first side having a generally round aperture for freely passing a portion of a chain therethrough, the aperture extending through the first side, the first side having a pair of chain slots each adapted for receiving a link of the chain in one of the chain slots such that an adjacent link in the chain is prevented from passing through the chain slot;

a second one of the sides being elongate with opposite ends, four door hinge slots extending through the second side, each of the door hinge slots being elongate and having longitudinal axes extending substantially parallel to the side edges; and a third one of the sides having a plurality of bolt slots for coupling to various bolt patterns used to attach door hinges to different vehicles, the bolt slots extending through the third side.

2. The system of claim 1 wherein the chain slots extend outwardly from the aperture.

3. The system of claim 2 wherein the pair of slots extend in diametrically opposite directions.

4. The system of claim 2 wherein the pair of chain slots are elongate and have longitudinal axes extending substantially parallel to the side edges.

5. The system of claim 1 wherein a first pair of the door hinge slots are transversely separated on the second side, each of the first pair of door hinge slots having a central transverse axis bisecting the longitudinal axis of the slot.

6. The system of claim 5 wherein the transverse central axis of each of the first pair of slots is positioned approximately midway between the opposite ends of the second side.

7. The system of claim 5 wherein a second pair of the door hinge slots has a common longitudinal axis extending through each of the door hinge slots.

8. The system of claim 7 wherein the common longitudinal axis is centrally located between the side edges of the second side, the second pair of door hinge slots being longitudinally separated.

9. The system of claim 7 wherein the central transverse axis of the first pair of door hinge slots pass approximately midway between the second pair of door hinge slots.

10. The system of claim 1 wherein the plurality of bolt slots include a first pair of bolt slots and a second pair of bolt slots, each pair of bolt slots having a common longitudinal axis passing through each of the bolt slots of the respective pair, the common longitudinal axis of the first pair of bolt slots intersecting the common longitudinal axis of the second pair of bolt slots at a substantially central location on the third side.

11. The system of claim 10 wherein an angle between the common axes of the first and second pairs of bolt slots measures approximately 60 degrees.

12. The system of claim 1 additionally comprising a pair of brackets for adjustably coupling to the door hinge slots of the second side of the main member and for engaging a respective end of a door hinge on a door post of the vehicle body, each of the brackets being adjustably slidable along one of the door hinge slots to accommodate coupling to door hinges having a range of hinge lengths.

13. The system of claim 12 wherein each of the brackets has a first end portion, a second end portion, and an intermediate portion linking the first and second end portions, the first and second end portions lying in substantially parallel planes, the intermediate portion lying in a plane oriented substantially perpendicular to the planes of the first and second end portions, the first and second end portions extending in substantially opposite directions.

14. The system of claim 13 wherein the first end portion has a bolt hole extending therethrough for receiving a fastener for securing the first end portion to the second side of the main member, wherein the second end portion has a hole for receiving a fastener for attaching the second end portion to a door hinge, and wherein the intermediate portion has a hinge post hole for removably receiving a hinge post of the vehicle body, the hinge post holes being axially alignable such that the hinge post holes are adapted for engaging respective ends of the hinge post of the vehicle.

15. The system of claim 1 additionally comprising a loop mounted on the main member for receiving a portion of a chain, the loop being looped about the main member.

16. The system of claim 15 wherein the loop has a triangular shape with three side extents such that one of the side extents is positionable at a vertex of the main member with the loop extending away from the vertex of the main member.

17. The system of claim 1 wherein the sides of the main member are integrally joined together to form a triangular perimeter wall having open sides for receiving a chain through the open sides.

18. The system of claim 1 wherein the sides of the main member are each substantially planar.

19. An attachment system for attaching to a portion of a vehicle body for pulling on the portion of the vehicle body, the system comprising:

a generally triangular main member having three sides, the main member having opposite side edges extending along each of the sides, the main member comprising:

a first one of the sides being adapted for coupling to a chain to facilitate pulling on the main member using the chain, an aperture extending through the first side for freely passing a portion of a chain therethrough, and a pair of chain slots extending through the first side and being adapted for receiving a link of the chain in one of the chain slots such that an adjacent link in the chain is prevented from passing through the chain slot;

a second one of the sides having a plurality of door hinge slots extending therethrough; and a third one of the sides having a plurality of bolt slots for coupling to various bolt patterns used to attach door hinges to different vehicles; and a loop mounted on the main member for receiving a portion of a chain, the loop being looped about the main member and having a triangular shape with three side extents.

20. A attachment system for attaching to a portion of a vehicle body for pulling on the portion of the vehicle body, the system comprising:

a generally triangular main member having three sides, each side having an interior face and an exterior face, each of the sides being substantially planar, the main member having opposite side edges extending along each of the sides, the main member comprising:

a first one of the sides being adapted for coupling to a chain to facilitate pulling on the main member using the chain, the first side having a generally round aperture for freely passing a portion of a chain therethrough, the aperture extending through the first side, the first side further having a pair of chain slots each being adapted for receiving a link of the chain such that an adjacent link in the chain is prevented from passing through the chain slot, the chain slots extending outwardly from the aperture, the pair of slots extending in diametrically opposite directions, the pair of slots being elongate and having longitudinal axes extending substantially parallel to the side edges;

a second one of the sides being elongate with opposite ends, four door hinge slots extending through the second side, each of the door hinge slots being elongate and having longitudinal axes extending substantially parallel to the side edges, wherein a first pair of the door hinge slots are transversely separated on the second side, each of the first pair of door hinge slots having a central transverse axis bisecting the longitudinal axis of the slot, the transverse central axis of each of the first pair of slots being positioned approximately midway between the opposite ends of the second side;

wherein a second pair of the door hinge slots have a common longitudinal axis extending through each of the door hinge slots, the common longitudinal axis being centrally located between the side edges of the second side, the second pair of door hinge slots being longitudinally separated;

wherein the central transverse axis of the first pair of door hinge slots passes approximately midway between the second pair of door hinge slots;

a third one of the sides having a plurality of bolt slots for coupling to various bolt patterns used to attach door hinges to different vehicles, the bolt slots extending through the third side;

wherein the plurality of bolt slots include a first pair of bolt slots and a second pair of bolt slots, each pair of bolt slots having a common longitudinal axis passing through each of the bolt slots of the respective pair, the common longitudinal axis of the first pair of bolt slots intersecting the common longitudinal axis of the second pair of bolt slots at a substantially central location on the third side;

a pair of brackets for adjustably coupling to the door hinge slots of the second side of the main member and for engaging a respective end of a door hinge on a door post of the vehicle body, each of the brackets being adjustably slidable along one of the door hinge slots to accommodate coupling to door hinges having a range of hinge lengths;

wherein each of the brackets has a first end portion, a second end portion, and an intermediate portion linking the first and second end portions, the first and second end portions lying in substantially parallel planes, the intermediate portion lying in a plane oriented substantially perpendicular to the planes of the first and second end portions, the first and second end portions extending in substantially opposite directions;

wherein the first end portion has a bolt hole extending therethrough for receiving a fastener for securing the first end portion to the second side of the main member;

wherein the second end portion has a hole for receiving a fastener for attaching the second end portion to a door hinge;

wherein the intermediate portion has a hinge post hole for removably receiving a hinge post of the vehicle body, the hinge post holes being axially alignable such that the hinge post holes are adapted for engaging respective ends of the hinge post of the vehicle;

a loop mounted on the main member for receiving a portion of a chain, the loop being looped about the main member, the loop having a triangular shape with three side extents such that one of the side extents is positionable at a vertex of the main member with the loop extending away from the vertex of the main member;

a pair of bracket bolts and a pair of bracket nuts, the bracket bolts being removably insertable through the bolt holes and the hinge post slots and engaging the bracket nuts for coupling the first end portion to the second side;

the sides being integrally joined together to form a triangular perimeter wall having open sides for receiving a chain through the open sides.

* * * * *